US008980058B2

(12) United States Patent
Feng et al.

(10) Patent No.: US 8,980,058 B2
(45) Date of Patent: Mar. 17, 2015

(54) MODIFIED FILLER COMPOSITION, PULP AND PAPER USING SAME

(71) Applicant: Goldeast Paper (Jiangsu) Co., Ltd, Zhenjiang (CN)

(72) Inventors: Yan Feng, Zhenjiang (CN); Dequanjiang, Zhenjiang (CN)

(73) Assignee: Goldeast Paper (Jiangsu) Co., Ltd, Zhenjiang, Jiangsu Province (CN)

( * ) Notice: Subject to any disclaimer, the term of this patent is extended or adjusted under 35 U.S.C. 154(b) by 0 days.

(21) Appl. No.: 14/160,522

(22) Filed: Jan. 21, 2014

(65) Prior Publication Data

US 2014/0216671 A1 Aug. 7, 2014

(30) Foreign Application Priority Data

Feb. 5, 2013 (CN) ..... 2013 1 0045147

(51) Int. Cl.
*D21H 11/00* (2006.01)
*D21H 17/45* (2006.01)

(52) U.S. Cl.
CPC ..... *D21H 17/455* (2013.01)
USPC ..... 162/168.3; 162/177; 162/158; 162/175

(58) Field of Classification Search
USPC ..... 162/168.3, 177, 158, 175; 428/372; 524/35
See application file for complete search history.

(56) References Cited

U.S. PATENT DOCUMENTS

2013/0180680 A1* 7/2013 Axrup et al. ..... 162/177
2014/0050922 A1* 2/2014 Chin et al. ..... 428/372

FOREIGN PATENT DOCUMENTS

SE 1050985-9 * 9/2010

* cited by examiner

*Primary Examiner* — Mark Halpern
(74) *Attorney, Agent, or Firm* — Cheng-Ju Chiang

(57) ABSTRACT

A modified filler composition used in papermaking is provided. The modified filler composition contains microfibrillated cellulose, and filler having negative charge, and a cationic polymer.

22 Claims, 2 Drawing Sheets

MODIFIED FILLER COMPOSITION, PULP AND PAPER USING SAME

CROSS-REFERENCE TO RELATED APPLICATION

This application claims the benefit of priority to People's Republic of China Patent Application No. 201310045147.8, filed Feb. 5, 2013, which is hereby incorporated by reference herein in its entirety.

BACKGROUND

1. Technical Field

The present disclosure relates to a modified filler composition used in the field of papermaking, method for making the modified filler composition, and a pulp and a paper using the modified filler composition.

2. Description of Related Art

Microfibrillated cellulose (MFC) is cellulose microfibrils defibrillated from cellulosic materials by mechanical methods and/or the TEMPO catalytic oxidation method. The MFC contains water-soluble cellulose and water-insoluble cellulose. The MFC has dimensions of about 100 nm to about several millimeters in length, and about 3 nm to tens of micrometers in diameter. Due to a large number of carboxyl groups, high aspect ratio, and good flexibility, the MFC made by the TEMPO catalytic oxidation method is generally added into paper pulp to improve the strength properties of the paper made using the same.

In the field of papermaking, adding filler to the paper pulp can effectively lower the cost. However, if both filler and MFC were added into the paper pulp, the filler would inhibit the hydrogen bonding of the MFC. In addition, the negatively charged MFC would repel the negatively charged or neutral filler, causing the finer filler particles to easily aggregate. Therefore, adding both filler and MFC to the paper pulp leads to a non-uniform distribution of filler particles on the MFC, thus decreasing the filler retention.

Therefore, there is room for improvement within the art.

BRIEF DESCRIPTION OF THE FIGURE

Many aspects of the disclosure can be better understood with reference to the following drawing. The components in the drawing are not necessarily drawn to scale, the emphasis instead being placed upon clearly illustrating the disclosure.

DETAILED DESCRIPTION

Figure 1:
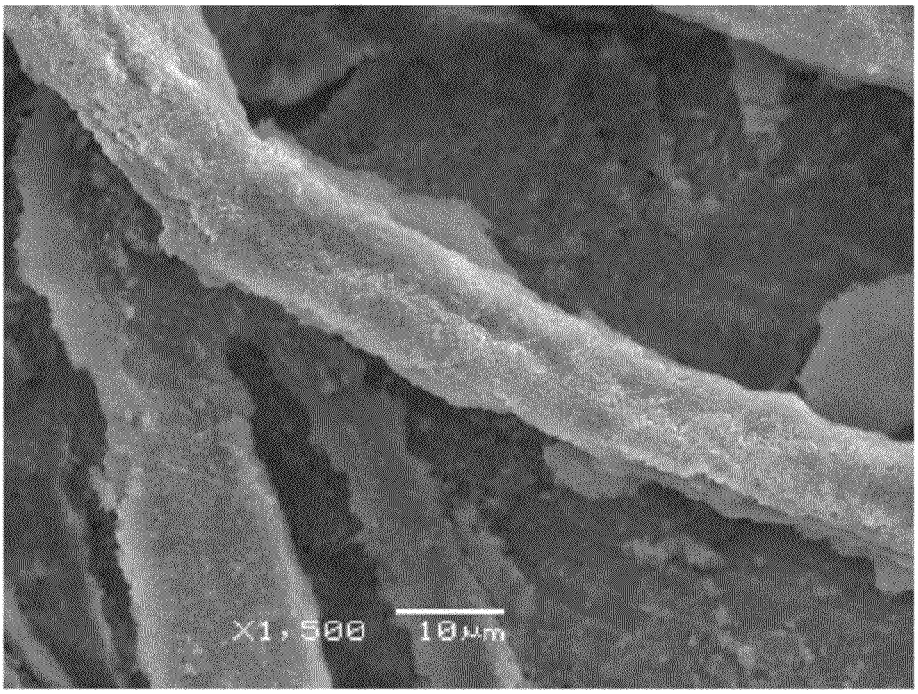
FIG. 1 is a scanning electron micrograph of a modified filler composition in this disclosure.

The MFC used in this disclosure is made by the TEMPO catalytic oxidation method.

One example for preparing the MFC by the TEMPO catalytic oxidation method may include the following steps: (1) providing bleached kraft pulp (BKP) and beating the pulp; (2) providing the beaten pulp having an amount by dry weight of 100 parts, and adjusting the concentration of the beaten pulp to about 2%; (3) adding a catalyst having an amount by dry weight of about 0.001 part to about 1 part to the above pulp, the catalyst being TEMPO ((2,2,6,6-Tetramethylpiperidin-1-yl)oxyl) or a derivative of TEMPO; (4) adding an assistant catalyst having an amount by dry weight of about 0.01 part to about 10 parts into the pulp, the assistant catalyst consisting of iodides, bromides, borates, or a mixture thereof; (4) adding an oxidant (for example sodium hypochlorite) having an amount by dry weight of about 0.1 part to about 20 parts into the pulp and stirring, keeping the pH value of the pulp to be in a range from about 9.5 to about 11; (5) the pulp and the oxidant reacting for about 0.5 hours to 4 hours to obtain a mixture containing oxidized celluloses, TEMPO, catalyst, and water; (6) removing the residual catalyst and TEMPO from the mixture; (7) mechanically treating the oxidized celluloses by ultrasonication or high-pressure homogenization.

During the reaction process of the cellulose and the oxidant, some hydroxyl groups (—OH) on the chains of glucose of the cellulose are selectively oxidized to carboxyl groups (—COOH), which have stronger negative charges than the hydroxyl groups. Thus, the oxidized cellulose molecules easily delaminate and defibrillate cellulose microfibrils due to the strong electrostatic repulsion in the cellulose molecules.

The MFC made by the TEMPO catalytic oxidation method has strong negative charge due to the carboxyl groups. The content of the carboxyl groups of the MFC is in the range from about 0.06 to about 1.7 mmol/g. The MFC has a complex composition, which substantially contains both water-soluble cellulose and water-insoluble cellulose. The water-soluble cellulose further contains nanocrystalline cellulose (NCC), nanofibrillated cellulose (NFC), and oligosaccharides, for example. The water-soluble cellulose (such as NFC) may be disposed on the cell wall of the water-insoluble cellulose. Note: the NCC and the NFC has differences in degree of crystallinity and length to diameter ratio. The NCC has a high degree of crystallinity of more than 70%, sometimes the degree of crystallinity of the NCC can reach 85% to 97%. While the NFC has a degree of crystallinity of less than 70%. The degree of crystallinity of the NFC is generally in a range from 20% to 70%. The NCC has a length to diameter ratio generally less than 250. The NFC has a length to diameter ratio more than 250, generally more than 500. Sometimes, the length to diameter ratio of the NFC can reach 2000.

The modified filler composition in this disclosure contains MFC, cationic polymer, and filler having negative particle charge, wherein the dry weight of the MFC is about 0.1% to about 10% of that of the filler, and the dry weight of the cationic polymer is about 0.1% to about 15% of that of the filler. The modified filler composition may further contain water.

The MFC in the modified filler composition is made by the TEMPO catalytic oxidation method disclosed by U.S. Pat. No. 6,379,494. The content of carboxyl groups of the MFC is in the range from 0.06 to 1.7 mmol/g. The MFC contains water-soluble cellulose having a mass percentage of 0.1% to 50% and water-insoluble cellulose having a mass percentage of 10% to 99.9%.

The content of carboxyl groups in the MFC can be measured by the following steps: (1) MFC having a dry weight of 0.3 g, deionized water having a volume of 55 ml, and sodium chloride solution having a concentration of 0.01 mol/L and a volume of 5 ml are mixed together and stirred to make a mixture; (2) hydrochloric acid solution having a concentration of 0.1 mol/L is added to the mixture to adjust the pH value of the mixture to be about 2.5 to about 3.0; (3) sodium hydroxide solution having a concentration of 0.04 mol/L is added to the mixture at a speed of 0.1 ml/min, and meantime the electrical conductivity of mixture is measured by an conductivity meter until the pH value of the mixture reach 11.0; (4) addition amount of the sodium hydroxide relative to the electrical conductivity of the mixture is plotted to obtain a curve figure; (5) consumption of the sodium hydroxide that reacts with the MFC can be calculated from the curve figure, and the content of carboxyl groups in the MFC can be calculated. Note: the electrical conductivity in the curve figure has a stationary stage, the consumption of the sodium hydroxide solution during the stationary stage of the electrical conductivity in the curve figure represents the consumption of the sodium hydroxide that reacts with the MFC.

The filler may comprise ground calcium carbonate (GCC), precipitated calcium carbonate (PCC), kaolin, talc, titanium dioxide powder, alumina, or any combination thereof. In this embodiment, more than 60% of the filler by weight has a particle diameter less than or equal to 2 p.m.

The filler particles may be surface modified by a dispersant having negative charge, which can cause the filler particles have negative charge. The filler particles are measured by a particle charge detector using filler slurry having a concentration of 10% to 20% at an ambient temperature. The model of the particle charge detector used in this disclosure is BTG PCD-04. The dispersant has a weight of about 0.001% to 5% of that of the filler. The dispersant may be selected, by way of example, from sodium polyacrylate, sodium polycarboxylic acid, sodium poly-allylsulfonate, and derivatives thereof. The filler particles having relatively small particle diameter may readily aggregate, causing aqueous pulp with filler to have a higher viscosity. The dispersant may cause the filler to be more unfiromly distributed and to have negative particle charge. Increasing the dosage of the dispersant in an aqueous suspension of pulp fibers and filler particles in many cases tends to increase the viscosity and the stability of the system.

The cationic polymer may be selected, by way of example, from cationic polysaccharide, cationic polyacrylamide, polyvinylamine, polyethylene imine, and derivatives thereof. In some embodiments, the cationic polymer may have a molecular weight of between $2\times10^3$ and $2\times10^6$. In one embodiment, the cationic polymer has a molecular weight of between $2\times10^4$ and $1\times10^6$.

The positively charged cationic polymer may function somewhat as a binder or a media for coupling the negatively charged MFC and the negatively charged filler together, thereby causing the filler to be distributed on the surface of the MFC relatively more stably and uniformly than systems lacking the cationic polymer or with lower concentrations thereof. Without wishing to be bound by theory, in the modified filler composition, the cationic polymer may bond on the surface of the MFC, and the filler may adhere to the surface of the cationic polymer; and/or the combination of the filler and the cationic polymer adhere to the surface of the MFC.

Figure 2:
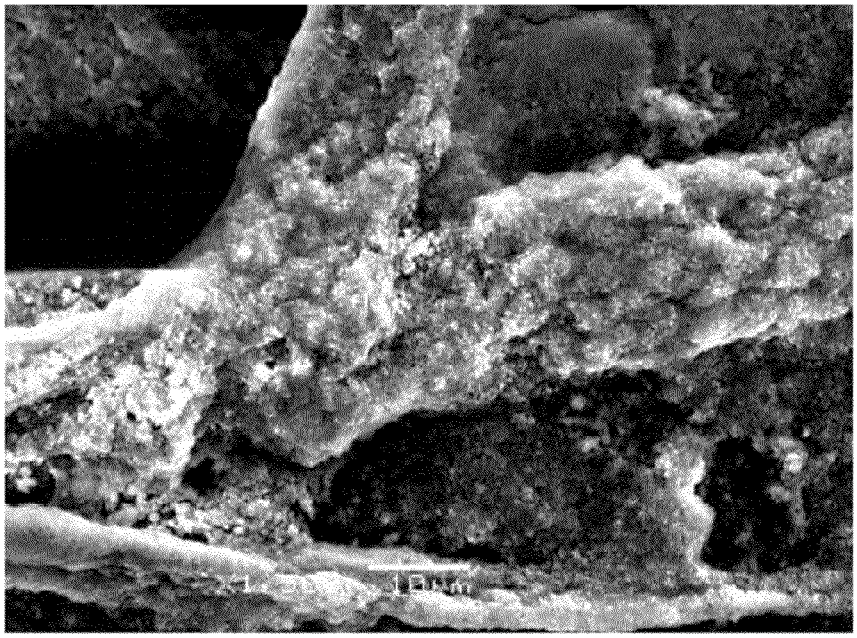
FIG. 2 is a scanning electron micrograph of a filler composition containing filler and MFC, but no cationic polymer.

FIG. 1 is a scanning electron micrograph of a modified filler composition containing MFC, cationic polymer, and filler having negative particle charge. FIG. 2 shows a scanning electron micrograph of a filler composition containing MFC and filler, but no cationic polymer, having negative particle charge. FIG. 2 shows obvious aggregation of the filler particles on the surface of the MFC, while FIG. 1 shows that the filler particles distribute much more uniformly on the MFC. The fillers in FIG. 1 and FIG. 2 were tested, and the test results are listed in Table 1 below. The test results demonstrate that the filler in FIG. 1 has a much more uniform particle size. Note: the particle size uniformity is a value calculated by dividing the standard deviation of the particle diameter by the mean particle size. The filler particle size data was obtained from the scanning electron micrograph by using the ImageJ software.

TABLE 1

| Test type | FIG. 1 | FIG. 2 |
|---|---|---|
| particle size uniformity of filler | 4.44 | 13.0 |
| Average particle size of filler | 1.1 μm | 4.2 μm |

The filler adsorbing on the surface of the MFC has a particle size uniformity of less than 10.

The modified filler composition can be made by directly mixing the filler having negative particle charge, the MFC, and the cationic polymer together. During the mixing process, in one embodiment. the temperature of the composition may be maintained in a range from 10° C. to 110° C., more specifically in a range from 20° C. to 70° C. In another embodiment, the temperature of the composition may be kept in a range from 20° C. to 50° C.

One example for preparing the modified filler composition may include the following steps: (1) mixing filler and water together to make a filler suspension; (2) adding dispersant having a weight of about 0.001% to 5% of that of the filler into the filler suspension to obtain a mixture; (2) adding the MFC and cationic polymer into the mixture, the dry weight of the MFC being about 0.1% to about 10% of that of the filler, the dry weight of the MFC being about 0.1% to about 15% of that of the filler; (4) stirring the mixture with a speed of about 800 revolutions per minute (RPM) for about 5 min between about 20° C. to about 110° C.

The modified filler composition may further contain a cross-linking agent. The cross-linking agent any suitable agent such as, by way of example, a borate cross-linking agent, a borax cross-linking agent, or a dialdehyde cross-linking agent (such as oxaldehyde or glutaric dialdehyde). The dry weight of the cross-linking agent may be from about 0.1% to about 15% of that of the cationic polymer. It is believed that the cross-linking agent promotes cross-linking of the cationic polymer and cross-linking between the cationic polymer and the MFC to form a network structure, which is beneficial for increasing the filler retention on the MFC.

A papermaking process using the above modified filler composition includes the following steps.

Step 1: providing a paper pulp.

Step 2: adding the above modified filler composition into the paper pulp, and selectively adding or not adding unmodified filler to the paper pulp.

Thus, the filler in the paper pulp is either all from the modified filler composition, or is a combination of the modified filler composition and the unmodified filler. The total weight of the filler added into the paper pulp may be, by way of example, from 10% to 300% of the dry weight of the pulp fiber. The weight of filler from the modified filler composition may be from 10% to 100% of the total weight of the filler in the paper pulp, such as from 50% to 100% or, alternatively, from 90% to 100% of the total weight of the filler in the paper pulp. In determining the percentages, the MFC, including that from the modified filler composition, is counted as a portion of the pulp fiber.

Step 3: adding starch into the paper pulp.

The starch has a dry weight of 1% to 10% of that of the pulp fiber. The starch may comprise, by way of example, anionic starch, oxidized starch, grafted starch, amphoteric starch, or any combination thereof.

Step 4: employing the paper pulp to make paper.

The paper pulp can be treated with retention aids before making paper. The retention aids may be one-component retention aids or three-component retention aids, for example Nanocrystalline cellulose (NCC) and/or the MFC may be used as an anionic retention aid in some embodiments.

Paper pulp made by the above papermaking process comprises pulp fiber, modified filler composition, and starch. The filler in the paper pulp is from the modified filler composition, or from both the modified filler composition and the unmodified filler.

Paper made by the above papermaking process may have an ash retention of from about 70% to about 99.9%, and a first-pass ash retention of about 65% to about 99.9%. In contrast, conventional paper typically has an ash retention of about 45% to about 90%, and a first-pass ash retention of about 40% to about 85%.

The paper made by the above papermaking process has a high ash retention. Without wishing to be bound by theory, it is believed that the reason may include one or more of the following:

(1) The MFC made by the TEMPO catalytic oxidation method has a complex composition and contains both water-soluble cellulose and water-insoluble cellulose. The water-insoluble cellulose has many carboxyl groups, causing it to delaminate due to the electrostatic repulsion. Thus, the fine filler particles and cationic polymer easily incorporate into the inside of the water-insoluble celluloses.

(2) The cationic polymer acts as a binder or a media for coupling the MFC and the filler together, and the filler may be able to distribute uniformly on the surface of the MFC.

(3) The surface of the filler particles adsorbs some of the water-soluble cellulose, improving the chemical reactivity of the filler. Thus, the filler with reactive functional groups chemically binds the pulp fiber.

The disclosure provides a modified filler composition containing cationic polymer acting as a binder for coupling the MFC and filler together, which causes the filler particles to uniformly distribute on the surface of the MFC. The paper pulp added with the modified filler composition generally has a high filler retention. Thus, paper made by the paper pulp may have a high ash retention.

EXAMPLE 1

In this embodiment, a paper was prepared by the following steps: (a) providing a MFC aqueous dispersion containing 2 g of MFC by dry weight; (b) adding 20 g of filler (GCC) and dispersant (sodium polyacrylate) having a weight of about 0.02% of that of the filler into the MFC aqueous dispersion, 95% of the filler by weight having a particle size of less than 2 μm; (c) adding cationic polyacrylamide (PVAm) having a weight of about 0.5% of that of the filler into the MFC aqueous dispersion to make a mixture; (d) stirring the mixture at a temperature of about 50° C. for about 5 minutes, thereby making the modified filler composition; (d) adding the modified filler composition into a Leaf bleached kraft pulp (LBKP) having a dry weight of 10 g and comprising hardwood fibers; (f) adding 0.2 g of starch into the LBKP; (g) diluting the LBKP and employing it to make paper.

Note: all the pulps used in Example 1 and the following Examples 2-6 and comparative Examples 1-4 were produced by Asia Pulp & Paper Co., Ltd.

EXAMPLE 2

In this embodiment, the modified filler composition and the paper was made by using the same steps and same parameters of Example 1 except that MFC aqueous dispersion in Example 2 contained 10 g of MFC by dry weight.

EXAMPLE 3

In this embodiment, the modified filler composition and the paper was made by using the same steps and same parameters of Example 1 except that 65% of the filler by weight having a particle size of less than 2 μm.

COMPARATIVE EXAMPLE 1

A comparative paper was made by the following steps: adding 20 g of filler (GCC) and 0.2 g of starch to a LBKP; diluting the LBKP and employing it to make paper.

The papers made in Examples 1-3 and Comparative Example 1 were tested, and the test results are listed in Table 2 below. The test results show that the ash content, ash retention and the first-pass ash retention of the paper in Examples 1-3 are much higher than those of the paper in Comparative Example 1.

TABLE 2

| Test type | COMPARATIVE EXAMPLE 1 | EXAMPLE 1 | EXAMPLE 2 | EXAMPLE 3 |
|---|---|---|---|---|
| Basis weight g/m$^2$ | 72.3 | 72.0 | 67.3 | 72.3 |
| Thickness μm | 94.7 | 90.0 | 87.8 | 89.7 |
| Paper bulk cc/g | 1.31 | 1.25 | 1.30 | 1.27 |
| Air permeability s | 10.5 | 21.4 | 5.7 | 8.8 |
| Fold endurance test, number of folds (1.0 kg) | 3 | 2 | 2 | 1 |
| Tensile index N · m/g | 17.4 | 19.3 | 13.9 | 14.1 |
| Cohesion kg · cm | 0.53 | 0.72 | 0.85 | 0.56 |
| Ash content % | 45.74% | 53.3% | 60.1% | 60.1% |
| First-pass ash retention % | 68.7% | 85.3% | 94.7% | 96.3% |
| ash retention % | 42.1% | 68.3% | 76.1% | 76.9% |

EXAMPLE 4

In this embodiment, a paper was prepared by the following steps: (a) providing a MFC aqueous dispersion containing 0.3 g of MFC by dry weight; (b) adding 60 g of filler (GCC) and dispersant (sodium polyacrylate) having a weight of about 0.01% of that of the filler into the MFC aqueous dispersion; (c) adding cationic polyacrylamide (PVAm) having a weight of about 0.5% of that of the filler and borate having a weight of about 1.5% of that of the PVAm into the MFC aqueous dispersion to make a mixture; (d) stirring the mixture at a temperature of about 50° C. for about 5 minutes, thereby making the modified filler composition; (d) mixing needle bleached kraft pulp (NBKP) having a percentage of 20%, leaf bleached kraft pulp (LBKP) having a percentage of 70%, and alkaline peroxide mechanical pulp (APMP) having a percentage of 10% together to make a mixed pulp having a dry weight of 20 g; (e) adding the modified filler composition to the mixed pulp; (f) adding 0.4 g of starch and 800 ppm three-component retention aids into the mixed pulp, the three-component retention aids containing cationic polyacrylamide (CPAM), bentonite, anionic polyacrylamide (APAM); (g) diluting the mixed pulp and employing it to make paper.

COMPARATIVE EXAMPLE 2

A comparative paper was made by using the same steps and same parameters of Example 4 but using no MFC.

The papers made in Example 4 and Comparative Example 2 were tested, and the test results are listed in Table 3 below. The test results show that the ash retention and the first-pass ash retention of the paper in Example 4 are much higher than those of the paper in Comparative Example 2.

TABLE 3

| Test type | COMPARATIVE EXAMPLE 2 | EXAMPLE 4 |
|---|---|---|
| Basis weight g/m$^2$ | 103.5 | 97.1 |
| Thickness μm | 120.6 | 113.8 |
| Paper bulk cc/g | 1.16 | 1.17 |
| Air permeability s | 17.1 | 17.0 |
| Fold endurance test, number of folds (1.0 kg) | 1 | 1 |
| Tensile index N · m/g | 9.6 | 9.0 |
| Cohesion kg · cm | 0.41 | 0.40 |
| Ash content % | 65.29% | 65.5% |
| First-pass ash retention % | 62.7% | 63.3% |
| ash retention % | 87.05% | 87.33% |

COMPARATIVE EXAMPLE 3

A comparative paper was made by the following steps: (a) mixing NBKP having a percentage of 50% and APMP having a percentage of 50% together to make a mixed pulp having a dry weight of 20 g; (b) adjusting concentration of the mixed pulp to 4%; (c) adding 2 g of filler (PCC) and 0.08 g of cationic starch into the mixed pulp; (d) diluting the mixed pulp to a concentration of 0.3% and employing it to make paper.

EXAMPLE 5

In this embodiment, a paper was prepared by the following steps: (a) providing a filler (PCC) aqueous dispersion containing 2 g of filler by dry weight; (b) adding MFC having a dry weight of about 0.1% of that of the filler and cationic polyvinylamine having a weight of about 0.1% of that of the filler into the filler aqueous dispersion to make a mixture; (c) stirring the mixture at a temperature of about 50° C. for about 5 minutes, thereby making the modified filler composition; (d) mixing NBKP having a percentage of 50% and APMP having a percentage of 50% together to make a mixed pulp having a dry weight of 20 g; (e) adding the modified filler composition to the mixed pulp; (f) adding 0.08 g of starch into the mixed pulp; (g) diluting the mixed pulp to a concentration of 0.3% and employing it to make paper.

COMPARATIVE EXAMPLE 4

A comparative paper 4 was made by using the same steps and same parameters of comparative example 3 except that filler in comparative example 4 has a mass of 5 g.

EXAMPLE 6

In this embodiment, the modified filler composition and the paper was made by using the same steps and same parameters of Example 5 except that the filler aqueous dispersion containing 5 g of filler by dry weight.

The papers made in Examples 5-6 and Comparative Examples 3-4 were tested, and the test results are listed in Table 4 below. The test results show that the ash retention and the first-pass ash retention of the paper in Example 5 are much higher than those of the paper in Comparative Example 3; the ash retention and the first-pass ash retention of the paper in Example 6 are much higher than those of the paper in Comparative Example 4.

TABLE 4

| Test type | COMPARATIVE EXAMPLE 3 | EXAMPLE 5 | COMPARATIVE EXAMPLE 4 | EXAMPLE 6 |
|---|---|---|---|---|
| Basis weight g/m$^2$ | 76.1 | 84.4 | 81.5 | 75.8 |
| Thickness μm | 184.5 | 196.4 | 184.2 | 170.9 |
| Paper bulk cc/g | 2.42 | 2.33 | 2.26 | 2.25 |
| Air permeability s | 4.1 | 4.7 | 4.1 | 4.0 |
| Fold endurance test, number of folds (1.0 kg) | 53 | 59 | 40 | 77 |
| Cohesion kg · cm | 0.87 | 0.96 | 0.92 | 1.01 |
| Ash content % | 4.16% | 6.25% | 10.78% | 14.58% |
| First-pass ash retention % | 43.4% | 66.7% | 60.4% | 85.3% |
| ash retention % | 45.8% | 68.8% | 64.7% | 87.5% |

It is believed that the exemplary embodiments and their advantages will be understood from the foregoing description, and it will be apparent that various changes may be made thereto without departing from the spirit and scope of the disclosure or sacrificing all of its advantages, the examples hereinbefore described merely being preferred or exemplary embodiments of the disclosure.

The invention claimed is:

1. A modified filler composition, comprising:

filler having negative charge;

microfibrillated cellulose (MFC) having a dry weight of 0.1% to 10% of that of the filler, the microfibrillated cellulose being made by TEMPO catalytic oxidation method; and cationic polymer having a dry weight of 0.1% to 15% of that of the filler;

wherein the microfibrillated cellulose has a carboxyl content of 0.06 to 1.7 mmol/g;

the microfibrillated cellulose comprises water-soluble cellulose having a mass percentage on a dry solids basis of 0.1% to 50% and water-insoluble cellulose having a mass percentage on a dry solids basis of 10% to 99.9%.

2. The modified filler composition as claimed in claim 1, wherein the water-soluble celluloses comprises nanocrystalline cellulose, nanofibrillated cellulose, and oligosaccharide.

3. The modified filler composition as claimed in claim 1, wherein the filler is surface modified by a dispersant, the dispersant has a weight of 0.001% to 5% of that of the filler; and the dispersant is selected from sodium polyacrylate, sodium polycarboxylic acid, sodium poly-allylsulfonate, and derivatives thereof.

4. The modified filler composition as claimed in claim 1, wherein the cationic polymer is selected from cationic polysaccharide, cationic polyacrylamide, polyvinylamine, polyethylene imine, and derivatives thereof.

5. The modified filler composition as claimed in claim 1, wherein the cationic polymer has a molecular weight between $2\times10^3$ and $2\times10^6$.

6. The modified filler composition as claimed in claim 5, wherein the cationic polymer has a molecular weight between $2\times10^4$ and $1\times10^6$.

7. The modified filler composition as claimed in claim 1, wherein the filler adsorbing on the surface of the MFC has a particle size uniformity of less than 10.

8. The modified filler composition as claimed in claim 1, wherein more than 60% of the filler by weight has a particle diameter less than or equal to 2 μm.

9. The modified filler composition as claimed in claim 1, wherein the modified filler composition further comprises a cross-linking agent, wherein the cross-linking agent is a borate cross-linking agent, a borax cross-linking agent, or dialdehyde cross-linking agent; and the dry weight of the cross-linking agent is about 0.1% to about 15% of that of the cationic polymer.

10. A pulp, comprising:

a modified filler composition, the modified filler composition comprising:

filler having negative charge;

microfibrillated cellulose having a dry weight of 0.1% to 10% of that of the filler, the microfibrillated cellulose being made by TEMPO catalytic oxidation method; and cationic polymer having a dry weight of 0.1% to 15% of that of the filler;

wherein the microfibrillated cellulose has negative charge and has a carboxyl content of about 0.06 to about 1.7 mmol/g; the microfibrillated cellulose comprises water-soluble cellulose having a mass percentage on a dry solids basis of 0.1% to 50% and water-insoluble cellulose having a mass percentage on a dry solids basis of 10% to 99.9%.

11. The pulp as claimed in claim 10, wherein the water-soluble celluloses comprises nanocrystalline cellulose, nanofibrillated cellulose, and oligosaccharide.

12. The pulp as claimed in claim 10, wherein the filler is surface modified by a dispersant to make the filler having negative particle charge, the dispersant has a weight of 0.001% to 5% of that of the filler; the dispersant is selected from sodium polyacrylate, sodium polycarboxylic acid, sodium poly-allylsulfonate, and derivatives thereof.

13. The pulp as claimed in claim 10, wherein the cationic polymer is selected from cationic polysaccharide, cationic polyacrylamide, polyvinylamine, polyethylene imine, and derivatives thereof.

14. The pulp as claimed in claim 10, wherein the pulp comprises filler, and the filler is either all from the modified filler composition, or is a combination of the modified filler composition and the unmodified filler; the total weight of the filler added into the paper pulp is 10% to 300% of the dry weight of the pulp fiber; and the weight of filler from the modified filler composition is 90% to 100% of the total weight of the filler in the pulp.

15. The pulp as claimed in claim 10, wherein the modified filler composition further comprises a cross-linking agent, wherein the cross-linking agent is a borate cross-linking agent, a borax cross-linking agent, or dialdehyde cross-linking agent; and the dry weight of the cross-linking agent is 0.1% to 15% of that of the cationic polymer.

16. The pulp as claimed in claim 10, wherein the pulp further comprises starch and retention aids.

17. A paper, comprising:

a modified filler composition, the modified filler composition comprising:

filler having negative charge;

microfibrillated cellulose having a dry weight of 0.1% to 10% of that of the filler, the microfibrillated cellulose being made by TEMPO catalytic oxidation method; and cationic polymer having a dry weight of 0.1% to 15% of that of the filler;

wherein the microfibrillated cellulose has negative charge and has a carboxyl content of 0.06 to 1.7 mmol/g; the microfibrillated cellulose comprises water-soluble cellulose having a mass percentage on a dry solids basis of 0.1% to 50% and water-insoluble cellulose having a mass percentage on a dry solids basis of 10% to 99.9%.

18. The paper as claimed in claim 17, wherein the paper has an ash retention of 70% to 99.9%, and a first-pass ash retention of 65% to 99.9%.

19. The paper as claimed in claim 17, wherein the water-soluble celluloses comprises nanocrystalline cellulose, nanofibrillated cellulose, and oligosaccharide.

20. The paper as claimed in claim 17, wherein the filler is surface modified by a dispersant to make the filler having negative particle charge, the dispersant has a weight of 0.001% to 5% of that of the filler; and the dispersant is selected from sodium polyacrylate, sodium polycarboxylic acid, sodium poly-allylsulfonate, and derivatives thereof.

21. The paper as claimed in claim 17, wherein the cationic polymer is selected from cationic polysaccharide, cationic polyacrylamide, polyvinylamine, polyethylene imine, and derivatives thereof.

22. The paper as claimed in claim 17, wherein the modified filler composition further comprises a cross-linking agent, the cross-linking agent is a borate cross-linking agent, a borax cross-linking agent, or dialdehyde cross-linking agent; and the dry weight of the cross-linking agent is 0.1% to 15% of that of the cationic polymer.

* * * * *